US006923668B2

(12) United States Patent
Tsai

(10) Patent No.: US 6,923,668 B2
(45) Date of Patent: Aug. 2, 2005

(54) LATERAL ENGAGEMENT STRUCTURE FOR AN ELECTRICAL CONNECTOR

(76) Inventor: Chou Hsuan Tsai, 15F, No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 10/882,128

(22) Filed: Jun. 29, 2004

(65) Prior Publication Data

US 2005/0003695 A1 Jan. 6, 2005

(30) Foreign Application Priority Data

Jul. 4, 2003 (TW) ..... 92118380 A

(51) Int. Cl.[7] ..... H01R 13/62
(52) U.S. Cl. ..... 439/326; 439/159
(58) Field of Search ..... 439/326–328, 439/159–160

(56) References Cited

U.S. PATENT DOCUMENTS 6,231,364 B1 * 5/2001 Liu ..... 439/326
6,517,378 B2 * 2/2003 Fumikura ..... 439/570
6,527,576 B1 * 3/2003 Omote ..... 439/326

* cited by examiner

*Primary Examiner*—Truc Nguyen
(74) *Attorney, Agent, or Firm*—Pro-Techtor International Services

(57) ABSTRACT

A lateral engagement structure for an electrical connector capable of engaging with a lateral side of a circuit board includes a main body and an elastic arm. The body includes vertical and horizontal plates, wherein a first stopper block is set at a middle of a front end of the vertical plate, and a space is formed below the first stopper block. The arm has a rear end connected to the body, a free front end, and a front section having an actuator and an engagement portion engaged with the board. The arm's front end is bent toward the first stopper block to form a first transversal plate. When the arm is elastically moved toward the vertical plate, the first transversal plate is stopped at the first stopper block, and the engagement portion still engages with the board. When the first transversal plate passes through the space, the engagement portion is caused to separate from the board.

14 Claims, 6 Drawing Sheets

LATERAL ENGAGEMENT STRUCTURE FOR AN ELECTRICAL CONNECTOR

BACKGROUND OF THE INVENTION

1. Field of the Invention

The invention relates to an electrical connector, and more particularly to a lateral engagement structure for an electrical connector.

2. Description of the Related Art

Referring to FIGS. 1 and 2, an electrical connector connected to a circuit board includes a plastic base 11, a plurality of terminals 15, and two lateral engagement structures 20. The terminals 15 are arranged inside the plastic base 11 and have pins 16 projecting over the front and rear ends of the plastic base 11. The lateral engagement structure 20 has one end fixed to two sides of the plastic base 11 and has a vertical plate 21 and a horizontal plate 22 perpendicular to each other. The vertical plate 21 has a rear end coupled to the horizontal plate 22 and a front end, which is a free end and may be elastically moved leftwards and rightwards. An actuator 23 and a laterally convex arc portion 24 and an engagement portion 25 are set on the front section of the vertical plate 21. A positioning surface 26 and a stopper 27 are set on the front section of the horizontal plate 22.

When the circuit board 28 is inserted for connection, engagement holes 29 at two sides thereof may engage with the convex arc portions 24 of the lateral engagement structures 20 and the engagement portions 25 may engage with the circuit board 28. Thus, the circuit board 28 may be firmly fixed and positioned. When the two lateral engagement structures 20 are rotated outwards, the engagement portions 25 may separate from the circuit board 28, and the circuit board 28 is ejected upwards owing to the resiliences of the terminals 15. Thus, the circuit board 28 may be taken out.

The above-mentioned lateral engagement structure 20 has the following drawbacks in positioning the circuit board 28.

1. After the circuit board 28 is fixed and when the leftward and rightward impact tests are performed, the vertical plate 21 is moved leftwards and rightwards owing to the impact force. When the engagement portion 25 separates from the circuit board 28, the circuit board is ejected. So, the above-mentioned conventional electrical connector cannot meet the requirement of resisting the lateral impact forces.

2. The vertical plate 21 and the horizontal plate 22 are connected to each only at rear ends such that the vertical plate 21 can be elastically actuated leftwards and rightwards. Thus, the overall lateral engagement structure 20 cannot form a strong L-shaped frame.

SUMMARY OF THE INVENTION

It is therefore an object of the invention to provide a lateral engagement structure for an electrical connector, wherein the engagement structure has the effect of laterally positioning an elastic arm so as to resist the lateral impact forces when the circuit board is positioned.

Another object of the invention is to provide a lateral engagement structure for an electrical connector, wherein the engagement structure has the effect of vertically positioning an elastic arm so as to resist the vertical impact forces when the circuit board is positioned.

Still another object of the invention is to provide a lateral engagement structure for an electrical connector, wherein the structure has a strong main body and an elastic arm that may be elastically moved leftwards and rightwards within the range restricted by the main body so that a stronger structure may be provided.

To achieve the above-mentioned objects, the invention provides a lateral engagement structure for an electrical connector capable of engaging with a lateral side of a circuit board. The engagement structure includes a main body and an elastic arm. The main body includes a vertical plate and a horizontal plate, wherein a first stopper block is set at a middle of a front end of the vertical plate, and a space is formed below the first stopper block. The elastic arm has a rear end connected to the main body, a front end that is a free end, and a front section having an actuator and an engagement portion to be engaged with the circuit board. The front end of the elastic arm is bent toward the first stopper block of the vertical plate to form a first transversal plate. When the elastic arm is elastically moved toward the vertical plate of the main body, the first transversal plate is stopped at the first stopper block, and the engagement portion still engages with the circuit board. When the first transversal plate passes through the space below the first stopper block, the engagement portion can be caused to separate from the circuit board.

According to the above-mentioned structure, when the elastic arm is moved outwards owing to the lateral forces, its first transversal plate is against the first stopper block while its engagement portion still engages with the circuit board. Thus, it is possible to ensure that the circuit board may be firmly positioned.

Other objects, features, and advantages of the invention will become apparent from the following detailed description of the preferred but non-limiting embodiments. The following description is made with reference to the accompanying drawings.

DETAILED DESCRIPTION OF THE INVENTION

Figures 1, 2:
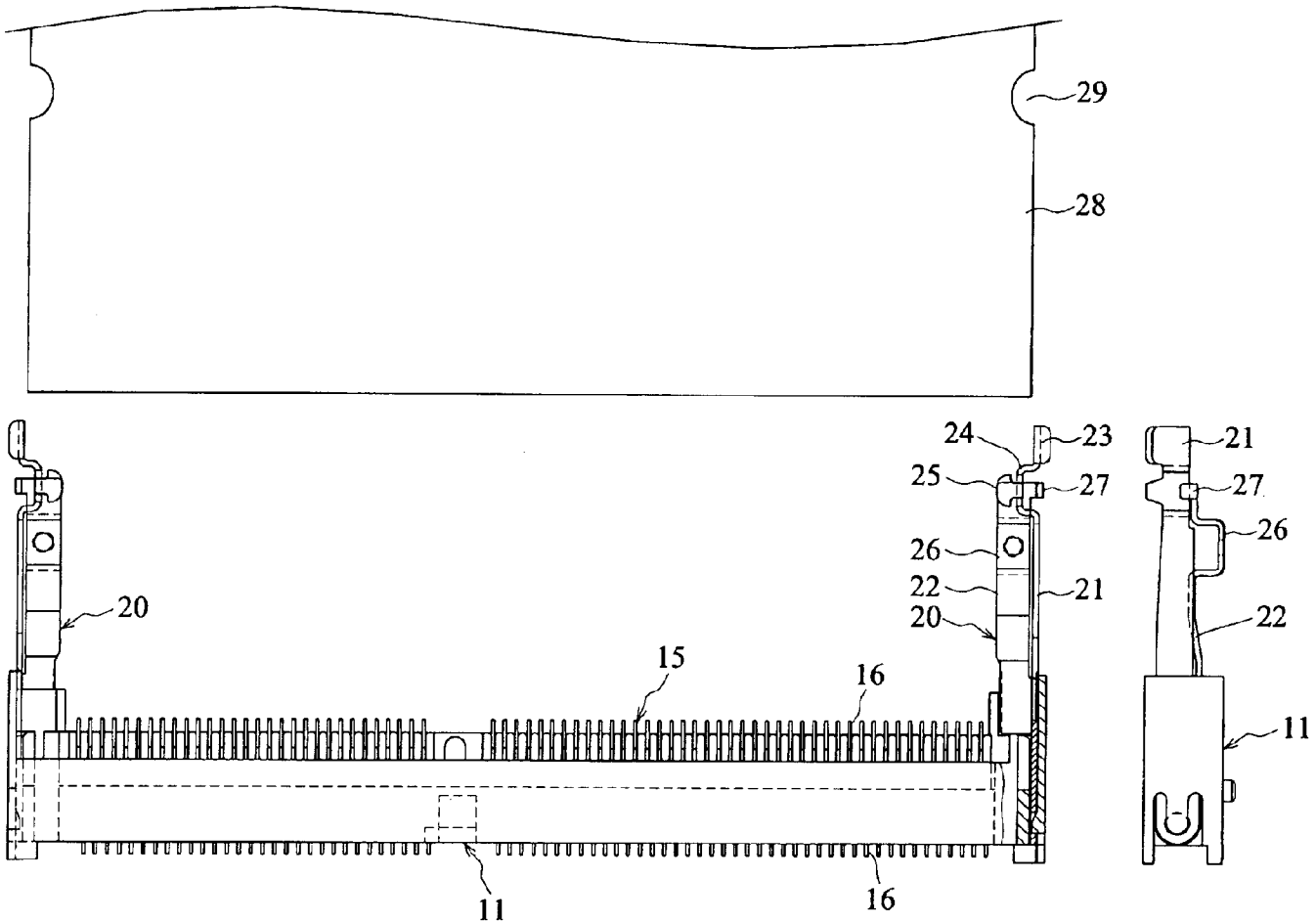
FIG. 1 (Prior Art)
FIG. 2 (Prior Art)
FIG. 1 is a top view showing a conventional electrical connector.
FIG. 2 is a side view showing the conventional electrical connector.
Figure 3:
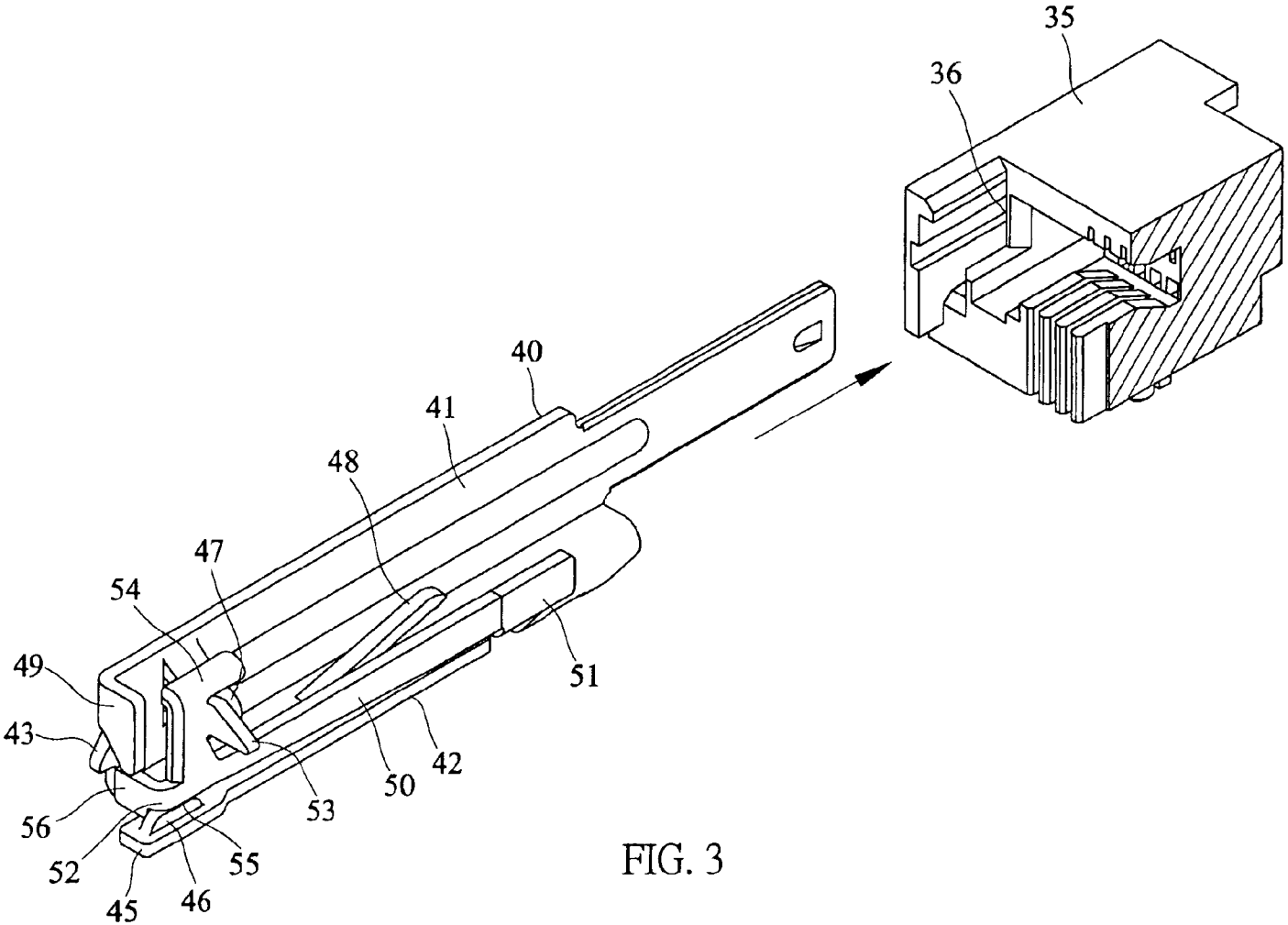
FIG. 3 is a pictorially exploded view showing a first embodiment of the invention.
Figure 4:
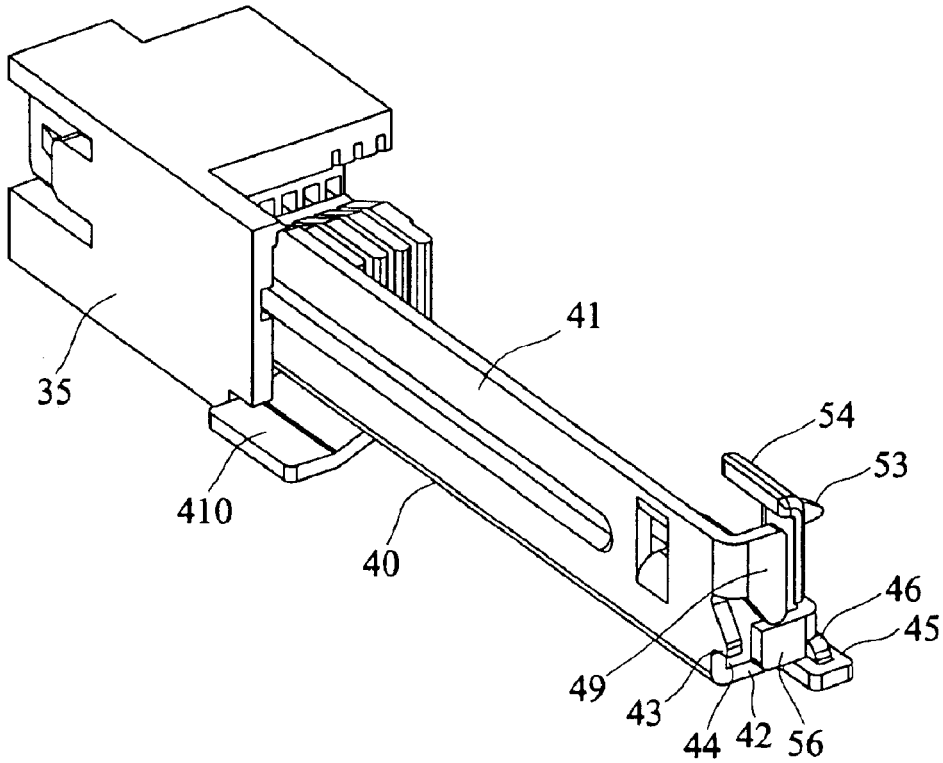
FIG. 4 is a pictorially assembled view showing the first embodiment of the invention.
Figure 5:
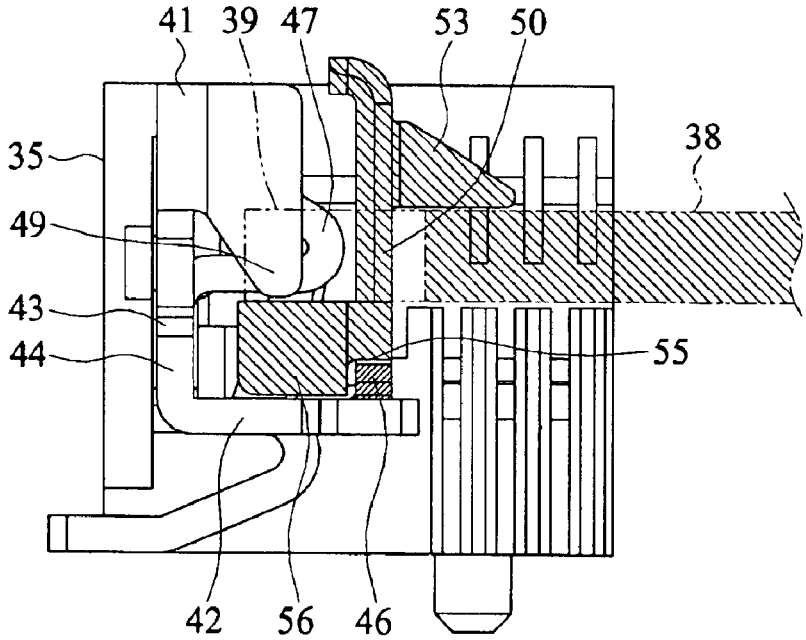
FIG. 5 is a schematic front view showing the first embodiment of the invention which is in engagement with a circuit board.

Referring to FIGS. 3 to 5, two lateral engagement structures for an electrical connector of the invention are disposed on two lateral sides of a plastic base 35 of the electrical connector. The lateral engagement structure is used to engage with a lateral side of an inserted circuit board 38. The lateral engagement structure includes a main body 40 and an elastic arm 50.

The main body 40 includes a vertical plate 41 and a horizontal plate 42, wherein one side of the vertical plate 41 is fully connected to one side of the horizontal plate 42 to form a firm angular frame. One end of the main body 40 is inserted into an arrangement slot 36 formed at one side of the plastic base 35. The middle of the front end of the vertical plate 41 is formed with a first stopper block 43 projecting frontward. A space 44 is formed below the first stopper block 43. The top of the front end of the vertical plate is bent toward the horizontal plate 42 direction to form a second transversal plate 49. The front end of the horizontal plate 42 is formed with a forward projection 45, on which a second stopper block 46 is disposed. In addition, the front section of the vertical plate 41 is pressed toward one side to form a third stopper block 47 to be engaged with an engagement hole 39 on the lateral side of the circuit board 38. The horizontal plate 42 is pressed to form an projecting elastic ground plate 48, and the rear end of the horizontal plate 42 is connected to a positioning surface 410 extending downwards.

The elastic arm 50 is bent upwards into a vertical state from the horizontal plate 42 of the main body 40. The elastic arm 50 has a rear end 51 connected to the horizontal plate 42 and a front end 52 that is free. The front section of the elastic arm 50 has an engagement portion 53 to be engaged with the circuit board 38, and an actuator 54. The top end of the engagement portion 53 is a bevel and the bottom end thereof is a horizontal plane. The lower edge 55 of the front end of the elastic arm 50 is against the second stopper block 46 and is bent toward the first stopper block 43 of the vertical plate 41 to form a first transversal plate 56. The first transversal plate 56 is below the second transversal plate 49 of the main body 40 and has one side stopped by the second stopper block 46. When the elastic arm 50 is elastically moved toward the vertical plate 41 of the main body 40, the first transversal plate 56 is stopped at the first stopper block 43.

Figure 6:
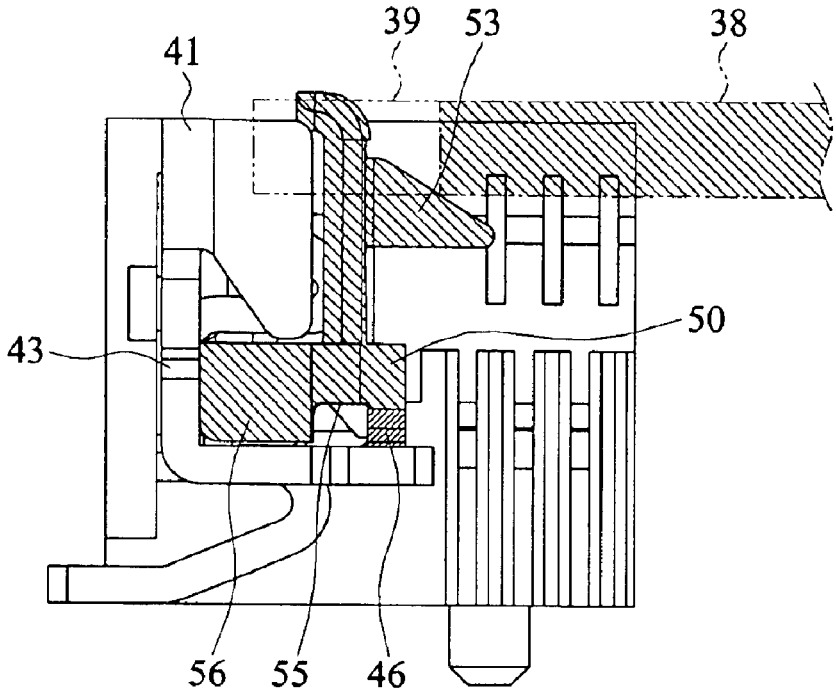
FIG. 6 is a schematic illustration showing a first operation of the first embodiment of the invention when the circuit board is inserted.

As shown in FIG. 6, when the circuit board 38 is slantingly inserted into the electrical connector and then pressed down for positioning, it will press the bevel on the top of the engagement portion 53 of the elastic arm 50 to cause the elastic arm 50 to elastically move toward the vertical plate 41. At this time, the lower edge 55 of the front end of the elastic arm 50 is away from the second stopper block 46 while the first transversal plate 56 is against the first stopper block 43.

Figure 7:
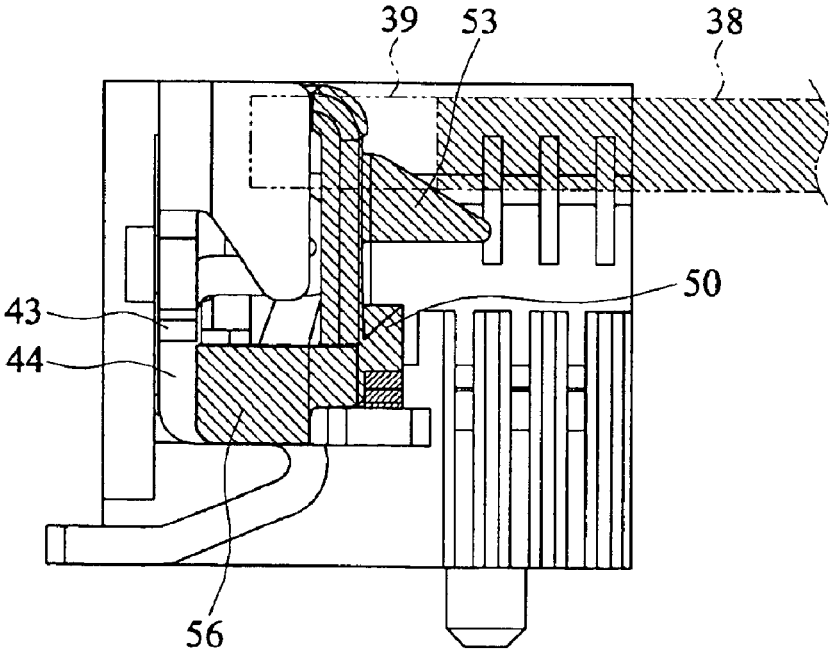
FIG. 7 is a schematic illustration showing a second operation of the first embodiment of the invention when the circuit board is inserted.
Figure 8:
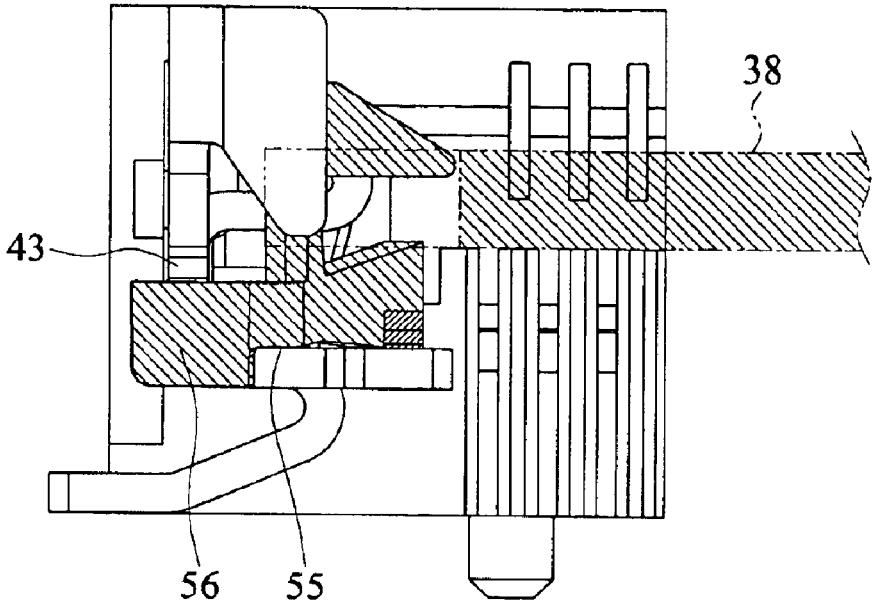
FIG. 8 is a schematic illustration showing a third operation of the first embodiment of the invention when the circuit board is inserted.

As shown in FIG. 7, when the circuit board 38 is continuously pressed downwards, the first transversal plate 56 of the elastic arm 50 is stopped by the first stopper block 43 and only can be moved downwards. As shown in FIG. 8, when the circuit board 38 is continuously pressed downwards, the first transversal plate 56 of the elastic arm 50 has been free from the stopping of the first stopper block 43 and thus can be moved outwards in the space 44 below the first stopper block 43. As shown in FIG. 5, when the circuit board 38 slides out of the bevel on the top of the engagement portion 53, the elastic arm 50 moves back by way of elasticity such that the engagement portion 53 is fixed above the circuit board 38, and the third stopper block 47 is engaged with the engagement hole 39 of the circuit board 38.

The operations of inserting the circuit board 38 have been mentioned above. If the circuit board 38 is to be removed, the finger may push the actuator 54 to move the elastic arm outwards and slightly downwards such that the circuit board and the engagement portion 53 may be separated, and the circuit board may thus be taken out. Although a pressing-down operation is needed, the operation causes no inconvenience. Because the pressing-down distance of the invention is very short and a pressing-down component force exists when the actuator 54 is actuated, the operation is very smooth when the first transversal plate 56 is blocked by the first stopper block 43 and is naturally moved downward to the space 44 followed by the lateral movement.

As shown in FIG. 5, after the circuit board 38 has been slantingly inserted into the electrical connector and then pressed down for positioning, the engagement portion 53 engages with the circuit board 38 and the third stopper block 47 engages with the engagement hole 39 on the lateral side of the circuit board 38 so as to position the circuit board 38 firmly. At this time, the lower edge 55 of the front end of the elastic arm 50 is against the second stopper block 46 of the main body 40, and the second transversal plate 49 of the main body 40 is against the first transversal plate 56 of the elastic arm 50. Consequently, when the up and down impact forces are used for test, the elastic arm 50 will not be shifted owing to the up and down impact forces because the vertical movement of the elastic arm 50 is fixed by the second transversal plate 49 and the second stopper block 46 of the main body 40.

Figure 9:
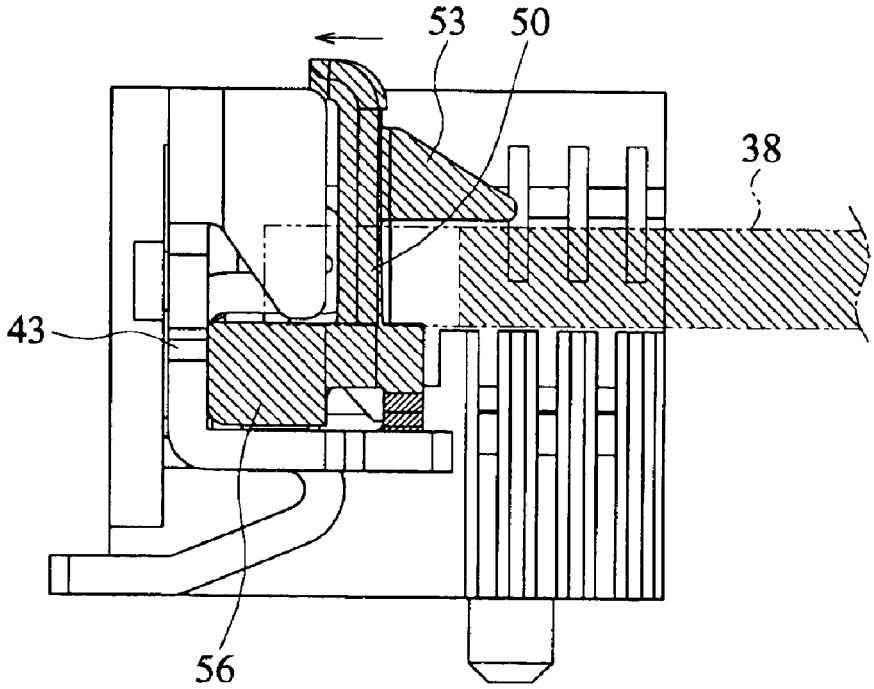
FIG. 9 is a schematic illustration showing an operation of the first embodiment of the invention when a lateral impact test is performed.

As shown in FIG. 9, when the lateral impact test is performed and the elastic arm 50 is moved laterally owing to the lateral impact, the first transversal plate 56 is against the first stopper block 43. At this time, the engagement portion 53 still engages with the circuit board 38, so the circuit board 38 is free from separating from the electrical connector owing to the lateral forces.

As mentioned above, the structure of the invention can firmly position the circuit board 38 regardless of the vertical impact forces or lateral impact forces. Particularly, the movement of the elastic arm 50 caused by the lateral impact forces can keep the engagement portion 53 within the range of the engagement circuit board 38, thereby solving the problem of incapable of resisting the elastic arm 50 in the prior art.

In addition, the embodiment has a main body 40, which is a fully angular and strong frame structure, and an elastic arm 50 that may be elastically moved leftwards and rightwards. So, the elastic arm 50 may be elastically moved leftwards and rightwards within the range restricted by the main body 40 so that a stronger structure may be provided.

Figure 10:
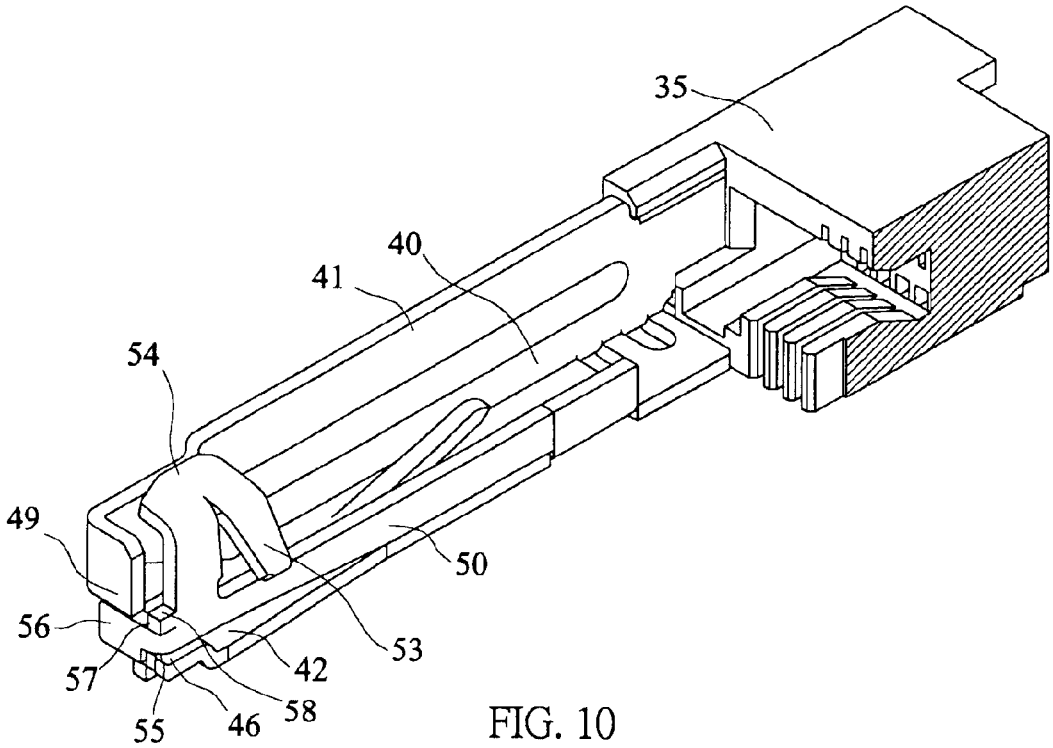
FIG. 10 is a pictorially assembled view showing a second embodiment of the invention.
Figure 11:
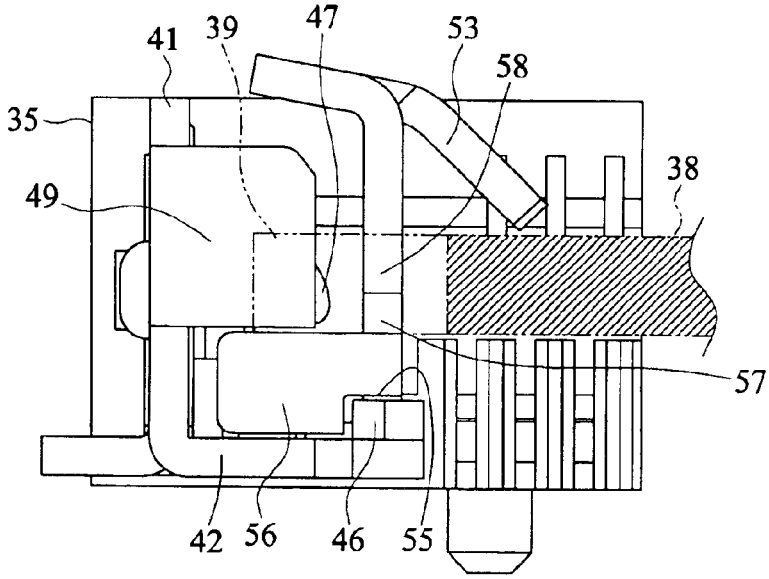
FIG. 11 is a schematic front view showing the second embodiment of the invention which is in engagement with a circuit board.

Referring to FIGS. 10 and 11, the second embodiment of the invention is almost the same as the first embodiment and includes a main body 40 and an elastic arm 50.

The main body 40 includes a vertical plate 41 and a horizontal plate 42. A side of the vertical plate 41 is fully connected to a side of the horizontal plate 42 so as to form a firmly angular frame. The front end of the vertical plate is bent toward the horizontal plate 42 to form a second transversal plate 49. A second stopper 46 is set at the front end of the horizontal plate 42. In addition, the front section of the vertical plate 41 is pressed toward one side to form a projecting third stopper 47 to be engaged with the engagement hole 39 on the lateral side of the circuit board 38.

The elastic arm 50 is bent, from the horizontal plate 42 of the main body 40, upwards into a vertical state. The rear end 51 of the arm 50 is connected to the horizontal plate 42 and the front end 52 thereof is free. The front section of the arm has an actuator 54 and an engagement portion 53 to be engaged with the circuit board 38. The engagement portion 53 is slant. A first stopper 57, above which a space 58 is formed, is set at the front end of the elastic arm. In addition, the lower edge 55 of the front end of the elastic arm is stopped at the second stopper 46 and bent toward the vertical plate 41 to form a first transversal plate 56. The first transversal plate 56 is below the second transversal plate 49 of the main body 40 and has a side stopped at the second stopper 46.

According to the above-mentioned structure, when the elastic arm 50 is elastically moved toward the vertical plate 41 of the main body 40, the first stopper 57 of the elastic arm 50 is stopped at the second transversal plate 49 of the main body 40, and the engagement portion 53 of the elastic arm 50 still engaged with the circuit board 38. When the elastic arm 50 is moved downwards and then elastically moved toward the vertical plate 41 of the main body, the second transversal plate 49 may pass through the space 58 above the first stopper 57 such that the engagement portion 53 is separated from the circuit board 38.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lateral engagement structure for an electrical connector, the lateral engagement structure being capable of engaging with a lateral side of a circuit board and comprising:

a main body comprising a vertical plate and a horizontal plate, wherein a first stopper block is set at a middle of a front end of the vertical plate, and a space is formed below the first stopper block; and an elastic arm having a rear end connected to the main body, a front end that is a free end, and a front section having an actuator and an engagement portion to be engaged with the circuit board, wherein:

the front end of the elastic arm is bent toward the first stopper block of the vertical plate to form a first transversal plate;

when the elastic arm is elastically moved toward the vertical plate of the main body, the first transversal plate is stopped at the first stopper block, and the engagement portion still engages with the circuit board; and when the first transversal plate passes through the space below the first stopper block, the engagement portion can be caused to separate from the circuit board.

2. The lateral engagement structure according to claim 1, wherein the front end of the vertical plate is bent to form a second transversal plate above the first transversal plate.

3. The lateral engagement structure according to claim 1, wherein the front end of the horizontal plate is formed with a forward projection, which has a second stopper block positioned at a lower edge of the elastic arm.

4. The lateral engagement structure according to claim 3, wherein the second stopper block stops a side of the first transversal plate.

5. The lateral engagement structure according to claim 1, wherein the elastic arm is bent, from the horizontal plate, upwards into a vertical state, and the rear end of the elastic arm is connected to the horizontal plate of the main body.

6. The lateral engagement structure according to claim 1, wherein the front section of the vertical plate is pressed toward one side to form a third stopper block.

7. The lateral engagement structure according to claim 1, wherein one side of the vertical plate of the main body is fully connected to one side of the horizontal plate.

8. A lateral engagement structure for an electrical connector, the lateral engagement structure being capable of engaging with a lateral side of a circuit board and comprising:

a main body comprising a vertical plate and a horizontal plate, wherein a second transversal plate is set at a front end of the vertical plate; and an elastic arm having a rear end connected to the main body, a front end that is free, and a front section having an actuator and an engagement portion to be engaged with the circuit board, the front end of the elastic arm has a first stopper, above which a space is formed, wherein when the elastic arm is elastically moved toward the vertical plate of the main body, the first stopper of the elastic arm is stopped at the second transversal plate of the main body, and the engagement portion of the elastic arm still engages with the circuit board; and when the elastic arm is moved downwards and then elastically moved toward the vertical plate of the main body, the second transversal plate passes through the space above the first stopper such that the engagement portion is separated from the circuit board.

9. The lateral engagement structure according to claim 8, wherein the front end of the elastic arm is bent to form a first transversal plate below the second transversal plate of the main body.

10. The lateral engagement structure according to claim 8, wherein a second stopper is set at the front end of the horizontal plate, and the second stopper is located at a lower edge of the elastic arm.

11. The lateral engagement structure according to claim 9, wherein a second stopper is set at the front end of the horizontal plate, and the second stopper is located at a lower edge of the elastic arm and is stopped at a side of the first transversal plate.

12. The lateral engagement structure according to claim 8, wherein the elastic arm is bent, from the horizontal plate, upwards into a vertical state, and the rear end of the elastic arm is connected to the horizontal plate of the main body.

13. The lateral engagement structure according to claim 8, wherein the front section of the vertical plate is pressed toward one side to form a third stopper block.

14. The lateral engagement structure according to claim 8, wherein one side of the vertical plate of the main body is fully connected to one side of the horizontal plate.

* * * * *